US011362471B2

(12) United States Patent
Ni

(10) Patent No.: US 11,362,471 B2
(45) Date of Patent: Jun. 14, 2022

(54) CONTACT AND MANUFACTURING METHOD THEREOF

(71) Applicant: Shenzhen Netsok Technology Co., Ltd., Shenzhen (CN)

(72) Inventor: Quan Ni, Shenzhen (CN)

(73) Assignee: Shenzhen Netsok Technology Co., Ltd., Shenzhen (CN)

( * ) Notice: Subject to any disclaimer, the term of this patent is extended or adjusted under 35 U.S.C. 154(b) by 133 days.

(21) Appl. No.: 16/757,928

(22) PCT Filed: Nov. 23, 2018

(86) PCT No.: PCT/CN2018/117068

§ 371 (c)(1),
(2) Date: Apr. 21, 2020

(87) PCT Pub. No.: WO2019/200916

PCT Pub. Date: Oct. 24, 2019

(65) Prior Publication Data

US 2020/0266596 A1 Aug. 20, 2020

(30) Foreign Application Priority Data

Apr. 18, 2018 (CN) ..... 201810350478.5

(51) Int. Cl.
*H01R 43/20* (2006.01)
*H01R 13/506* (2006.01)
*H01R 43/00* (2006.01)

(52) U.S. Cl.
CPC ..... *H01R 43/20* (2013.01); *H01R 13/506* (2013.01); *H01R 43/007* (2013.01)

(58) Field of Classification Search
None
See application file for complete search history.

(56) References Cited

U.S. PATENT DOCUMENTS 4,120,557 A * 10/1978 Horrocks ..... H01R 13/15 439/827
4,128,293 A * 12/1978 Paoli ..... H01R 13/187 439/843

(Continued)

FOREIGN PATENT DOCUMENTS

CN 203503846 U 3/2014
CN 107516785 A 12/2017

(Continued)

OTHER PUBLICATIONS

International Search Report dated Feb. 28, 2019, Application No. PCT/CN2018/117068.

*Primary Examiner* — Oscar C Jimenez
(74) *Attorney, Agent, or Firm* — The Dobrusin Law Firm, PC

(57) ABSTRACT

A contact and a manufacturing method thereof are provided. The contact includes a metal cylinder formed as a single body, the metal cylinder has an undulant sidewall having a slit, the sidewall of the metal cylinder includes a plurality of inward-concave structures and a plurality of outward-convex structures extending in a length direction of the metal cylinder, the plurality of inward-concave structures are recessed toward a central axis of the metal cylinder, and the plurality of outward-convex structures protrude away from the central axis of the metal cylinder. The contact according to the present disclosure may transmit a large current or signal, and have low loss in electric power.

10 Claims, 4 Drawing Sheets

(56) References Cited

U.S. PATENT DOCUMENTS

| | | | | |
|---|---|---|---|---|
| 5,083,927 | A * | 1/1992 | Herard | H01R 12/58 439/80 |
| 10,135,167 | B2 * | 11/2018 | Wollitzer | H01R 13/187 |
| 11,139,600 | B1 * | 10/2021 | Kinsey, Jr | H01R 13/111 |
| 2011/0252657 | A1 * | 10/2011 | Sato | G01R 1/06716 33/561 |
| 2016/0211590 | A1 * | 7/2016 | Saur | H01R 4/48 |

FOREIGN PATENT DOCUMENTS

| | | | |
|---|---|---|---|
| CN | 108390235 | A | 8/2018 |
| CN | 208385819 | U | 1/2019 |

* cited by examiner

FIG. 1 (Representative Figure)
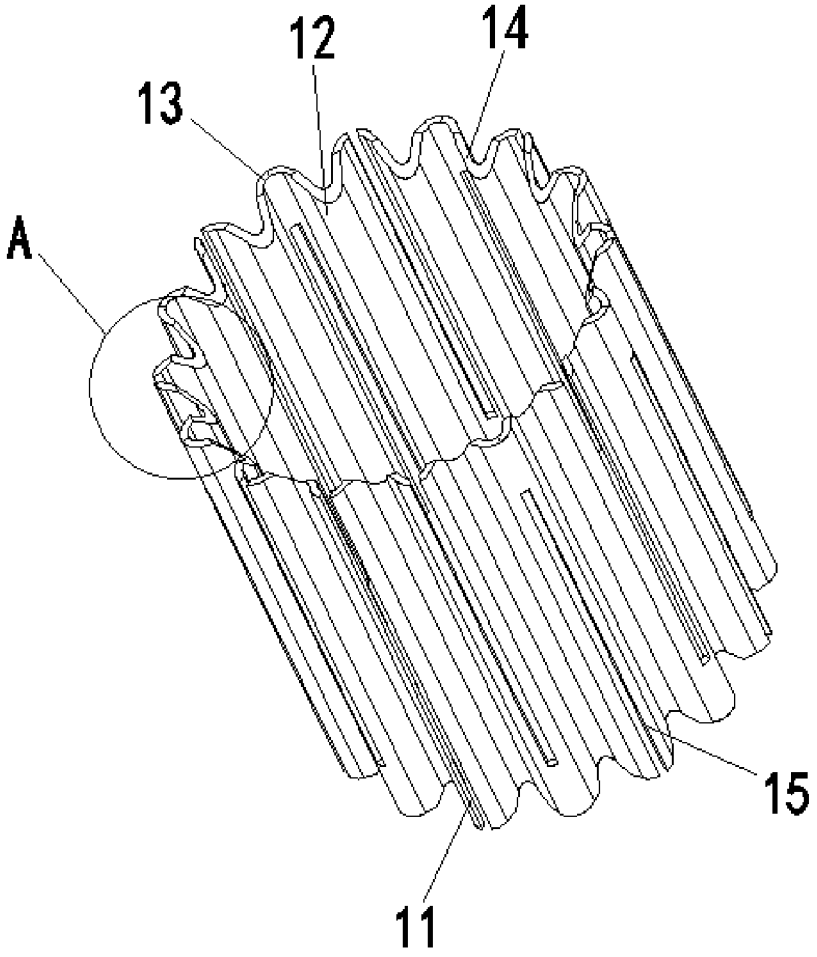
FIG. 2
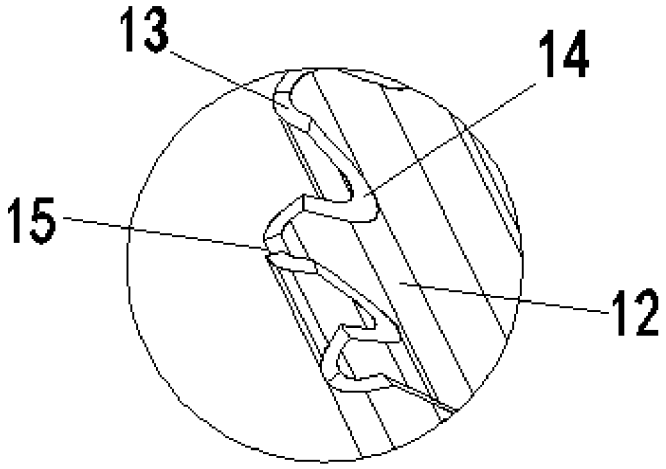

CONTACT AND MANUFACTURING METHOD THEREOF

BACKGROUND

1. Field

The present disclosure relates to a technical field of power conduction and signal conduction, and particularly, to a contact.

2. Description of the Related Art

In the related art, there are mainly two types of the insertion hole of a contact, the first type is an elastic sheet-type, the second type is a leaf spring-type. The elastic sheet-type insertion hole is formed by coiling one end of an elastic metal strip to an elastic sheet shape, and may be electrically connecting with a pin through the convex elastic sheet structure when the pin is inserted. In this case, the contact area between the elastic sheet structure and the pin is too small, which causes an excessive resistance, and thus a current flow through the elastic sheet-type contact is too small. The leaf spring-type hole is formed by stamping an elastic metal sheet and cutting it into a plurality of metal strips connected at both ends to form a fence shape, and then coiling the metal sheet into a cylinder, and recessing the cylinder at the middle portion such that each of the plurality of metal strips is bent at the middle portion thereof and is recessed toward the central axis of the cylinder, forming a cylinder-shaped structure having diameters at both ends larger than that at a middle portion. A pin may be in contact with each of the plurality of metal strips to achieve an electrical connection when the pin passes through the middle portion of the cylinder having a small diameter. In this case, although the contact area between the pin and the leaf springs (i.e., the plurality of metal strips) is increased to reduce the resistance such that a large current or signal may flow through the contact, a conductive distance between the position where the metal strips contact the pin and both ends of the metal strips is too long such that the resistance of the contact is on the contrary become larger, and thus there is great loss in electric power flowing through the contact.

SUMMARY

The present disclosure provides a contact capable of transmitting a large current or signal and having low loss.

Technical solution of the contact according to the present disclosure:

A contact according to the present disclosure includes a metal cylinder formed as a single body, the metal cylinder has an undulant sidewall having a slit, the sidewall of the metal cylinder includes a plurality of inward-concave structures and a plurality of outward-convex structures extending in a length direction of the metal cylinder, the plurality of inward-concave structures are recessed toward a central axis of the metal cylinder, and the plurality of outward-convex structures protrude away from the central axis of the metal cylinder.

Preferably, the inward-concave structures have inclined surfaces at ends thereof, and the inclined surfaces are inclined inward and toward the central axis of the metal cylinder.

Preferably, the plurality of inward-concave structures and the plurality of outward-convex structures are arranged uniformly at a constant interval in a corrugated shape.

Preferably, the outward-convex structures include grooves disposed on tangents at tops of the outward-convex structures.

Preferably, the grooves extend alternately from both ends of the metal cylinder.

Preferably, a sleeve is disposed outside the metal cylinder, and a snap ring is disposed at an opening of the sleeve to fasten the metal cylinder.

The present disclosure also provides a method of manufacturing a contact, including:

stamping a metal sheet to form concave-convex structures;

chamfering ends of concave structures of the concave-convex structures;

performing notching on tangents at tops of the concave-convex structures to form grooves;

coiling the metal sheet to form a metal cylinder, wherein the concave structures are disposed inside the metal cylinder, and outward-convex structures of the concave-convex structures are disposed outside the metal cylinder; and inserting the metal cylinder into a sleeve having a snap ring at an opening of the sleeve, wherein the metal cylinder resiles and expands to be pressed against an inner wall of the sleeve.

Preferably, the grooves extend alternately from both ends of the metal cylinder, in tangent directions at the tops of the concave-convex structures, respectively.

Preferably, the grooves are disposed on tangents at tops of the outward-convex structures.

Preferably, after coiling the metal sheet to form the metal cylinder, the metal cylinder is heat-treated for 1 to 2.5 hours at a temperature in a range of 350 to 420° C.

Advantageous effects of the contact according to the present disclosure:

The inward-concave structures contact the pin to increase the effective conductive cross sectional area and reduce the resistance of the conductor, and thus a large current or signal may be transmitted. In addition, the distance between the tops of the inward-concave structures and the tops of the outward-convex structures is relatively short, that is, the conductive distance is reduced, thereby further reducing the resistance of the conductor, and thus the loss in the electric power and signal may be reduced.

BRIEF DESCRIPTION OF THE DRAWINGS

FIG. 1 is a structure schematic view illustrating a contact according to an exemplary embodiment of the present disclosure.

FIG. 2 is an enlarged view illustrating region "A" in FIG. 1.

DETAILED DESCRIPTION

Hereinafter, the present disclosure is further illustrated and described with reference to exemplary embodiments and accompanying drawings.

Figure 3:
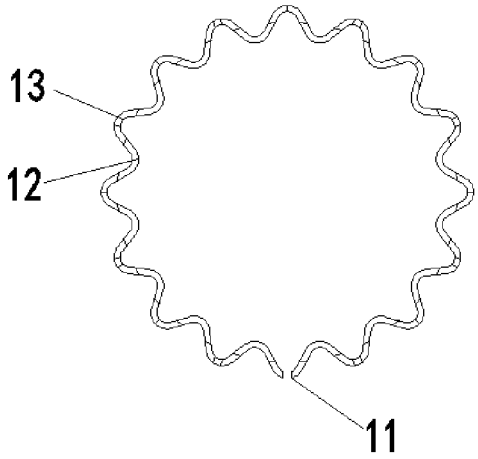
FIG. 3 is a schematic top plan view illustrating a contact according to an exemplary embodiment of the present disclosure.
Figure 4:
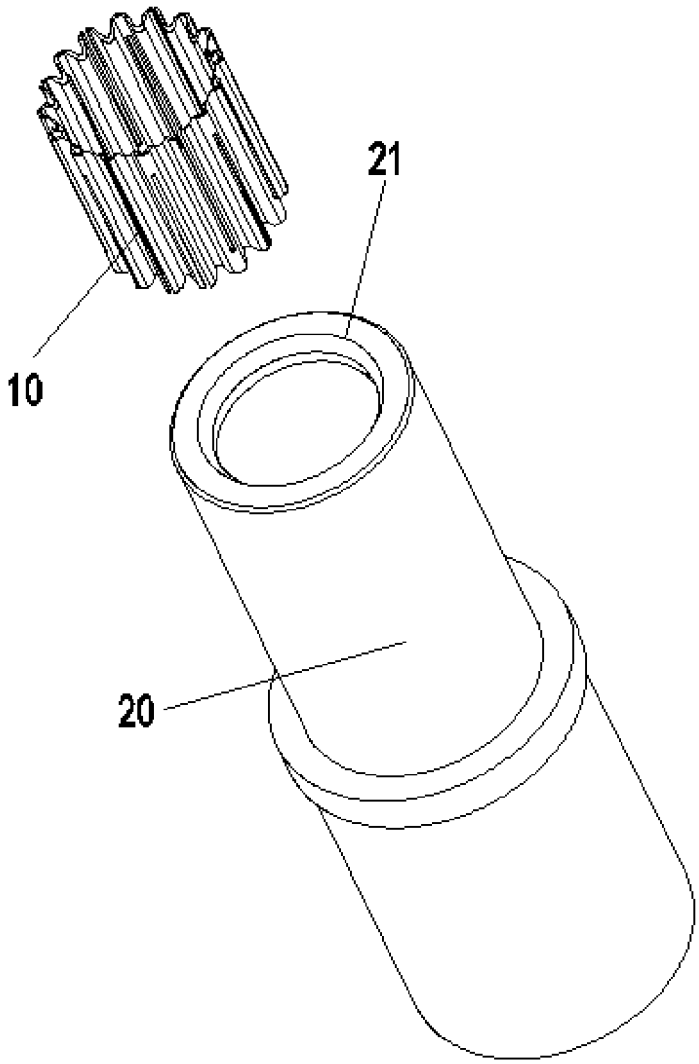
FIG. 4 is a schematic exploded perspective view illustrating a structure in which a contact is to be assembled, according to an exemplary embodiment of the present disclosure.
Figure 5:
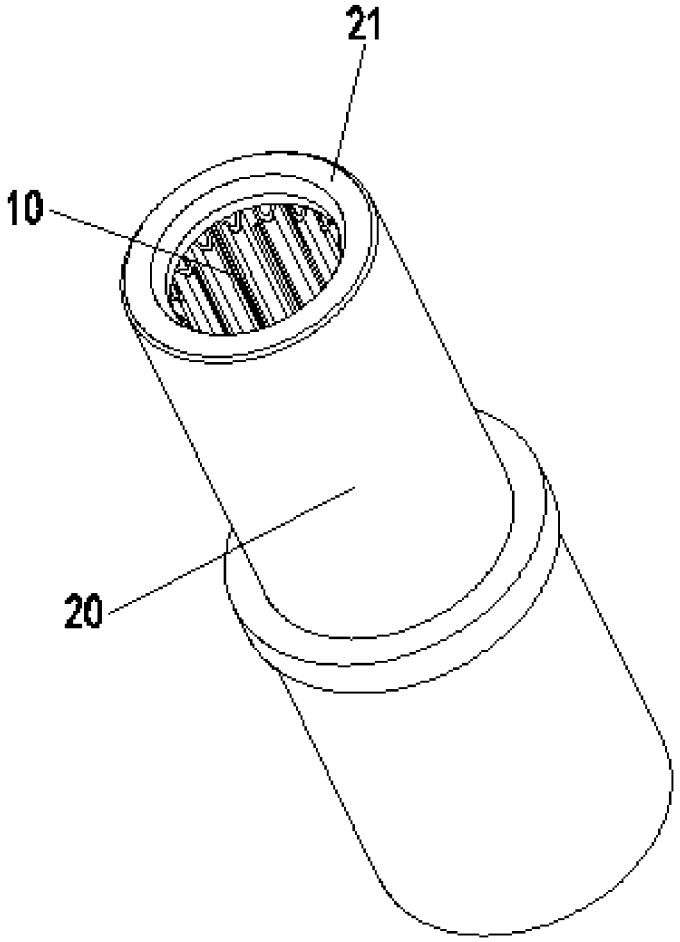
FIG. 5 is a schematic perspective view illustrating a structure in which a contact has been assembled, according to an exemplary embodiment of the present disclosure.
Figure 6:
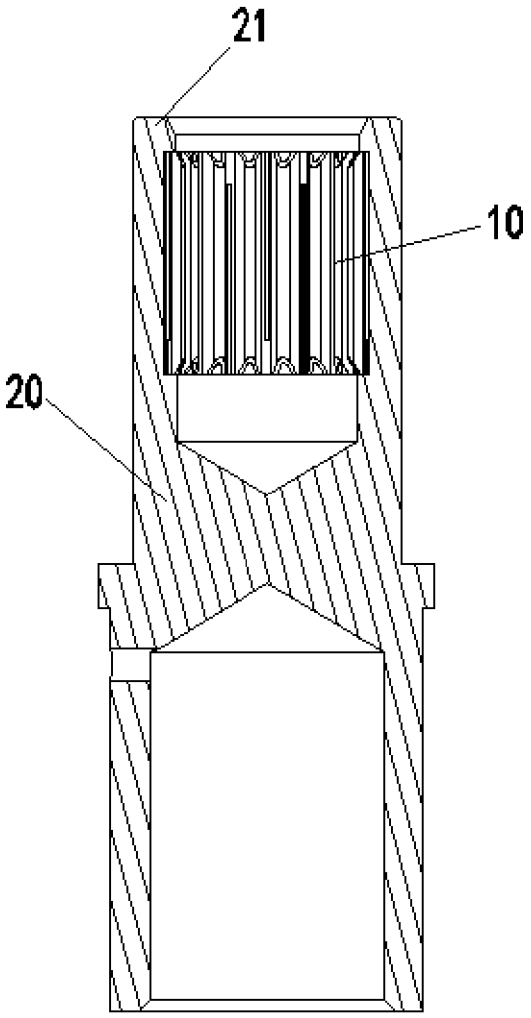
FIG. 6 is a schematic sectional view illustrating a structure in which a contact has been assembled, according to an exemplary embodiment of the present disclosure.
Figure 7:
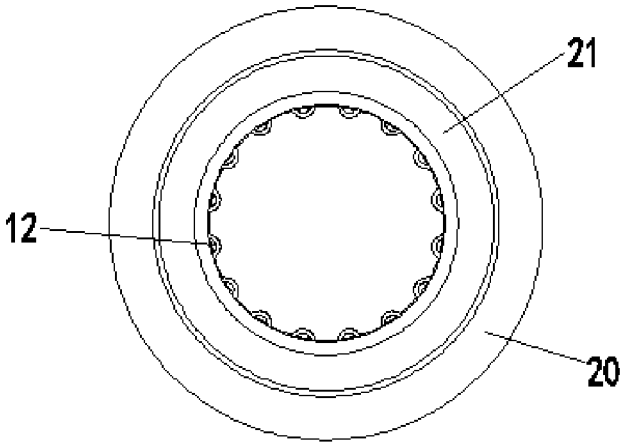
FIG. 7 is a schematic top plan view illustrating a structure in which a contact has been assembled, according to an exemplary embodiment of the present disclosure.

Referring to FIGS. 1 to 3, a contact according to an exemplary embodiment of the present disclosure includes a metal cylinder 10 formed as a single body. The metal cylinder 10 has an undulant sidewall having a (for example, one) slit 11. The sidewall of the metal cylinder 10 includes a plurality of inward-concave structures 12 and a plurality of outward-convex structures 13 extending in a length direction of the metal cylinder 10. The plurality of inward-concave structures 12 are recessed toward a central axis of the metal cylinder 10, and the plurality of outward-convex structures 13 protrude away from the central axis of the metal cylinder 10.

Contact resistance R (Ω) (in other words, conductor resistance of a contact) is affected by factors including effective conductive distance L (m), resistivity ρ (Ω·mm$^2$/m) and effective conductive cross sectional area A (mm$^2$) of a conductor. The influence of the factors on the contact resistance R is represented by Equation 1:

$$R = \frac{L \cdot \rho}{A} \quad \text{[Equation 1]}$$

The contact according to an exemplary embodiment of the present disclosure has the increased contact area between tops of the inward-concave structures 12 and a pin, that is, the increased effective conductive cross sectional area A, when compared with a contact according to the related art. Therefore, according to Equation 1, a value of the contact resistance R is reduced, thereby achieving transmission of a large current or signal. In addition, a distance between the tops of the inward-concave structures 12 and tops of outward-convex structures 13 is relatively short, that is, the conductive distance L is shortened. Therefore, according to Equation 1, the value of the contact resistance R may be further reduced. Assuming that the material of the conductor is not changed (i.e., regardless of the resistivity ρ of the conductor), the value of the contact resistance R may be reduced by increasing the conductive cross sectional area A and shortening the conductive distance L, thereby allowing the contact to transmit a large current, and a better effect of reducing loss in the electric power and signal may be achieved.

The inward-concave structures 12 may have inclined surfaces 14 at ends thereof. The inclined surfaces 14 are inclined inward and toward the central axis of the metal cylinder 10 to form an annular inclined surface. When the pin is being inserted, the inclined surfaces 14 may guide the insertion of the pin such that the pin is inserted more smoothly.

According to an exemplary embodiment of the present disclosure, the plurality of inward-concave structures 12 and the plurality of outward-convex structures 13 may be arranged uniformly at a constant interval in a corrugated shape.

Grooves 15 may be disposed on tangents at tops of the outward-convex structures 13 to enhance the elasticity of the metal cylinder 10. The grooves 15 may extend alternately from both ends of the metal cylinder 10 such that a force applied to the metal cylinder 10 is uniform, and the metal cylinder 10 is prevented from being deformed in a certain direction.

Referring to FIGS. 4 to 7, a sleeve 20 may be disposed outside the metal cylinder 10. A snap ring 21 may be disposed at an opening of the sleeve 20 to fasten the metal cylinder 10.

The First Embodiment

In the present disclosure, a method of manufacturing the above-described contact is provided, the method including:

stamping a metal sheet to form concave-convex structures;

chamfering ends of concave structures of the concave-convex structures;

performing notching on tangents at tops of the concave-convex structures to form grooves;

coiling the metal sheet to form a metal cylinder, wherein the concave structures are disposed inside the metal cylinder, and outward-convex structures of the concave-convex structures are disposed outside the metal cylinder; and inserting the metal cylinder into a sleeve having a snap ring at an opening of the sleeve, wherein the metal cylinder resiles and expands to be pressed against an inner wall of the sleeve.

In the performing notching on the tangents at the tops of the concave-convex structures, the grooves may extend alternately from both ends of the metal cylinder, in tangent directions at the tops of the concave-convex structures, respectively. The grooves may be disposed on tangents at tops of the outward-convex structures.

The method according to the First Embodiment is applicable to a beryllium copper material (e.g., C17410 HT) with excellent elasticity which has been heat-treated in a factory. The contact manufactured using the method is capable of transmitting a large current or signal and achieving low loss in power. Further, the contact manufactured using the method may allow smooth insertion and extraction of a pin, and may have excellent elasticity, resistance to deformation, and a simple and practical structure.

The Second Embodiment stamping a metal sheet to form concave-convex structures;

chamfering ends of concave structures of the concave-convex structures;

performing notching on tangents at tops of the concave-convex structures to form grooves;

coiling the metal sheet to form a metal cylinder, wherein the concave structures are disposed inside the metal cylinder, and outward-convex structures of the concave-convex structures are disposed outside the metal cylinder;

heat-treating the metal cylinder for 1 to 2.5 hours at a temperature in a range of 350 to 420° C.; and inserting the metal cylinder into a sleeve having a snap ring at an opening of the sleeve, wherein the metal cylinder resiles and expands to be pressed against an inner wall of the sleeve.

In the performing notching on the tangents at the tops of the concave-convex structures, the grooves may extend alternately from both ends of the metal cylinder, in tangent directions at the tops of the concave-convex structures, respectively. The grooves may be disposed on tangents at tops of the outward-convex structures.

The method according to the Second Embodiment is applicable to a high-beryllium copper material (e.g., US Standard No. C17200 or Chinese Standard No. QBe2.0, etc.) having relatively poor elasticity. The contact manufactured using the method is capable of transmitting a large current or signal and achieving low loss in power. Further, the contact manufactured using the method may allow smooth insertion and extraction of a pin, and may have excellent elasticity, resistance to deformation, and a simple and practical structure. In addition, the improved elasticity and resistance to fatigue of the contact may be obtained by the heat treatment.

In addition, an electroplating treatment may be further performed on the contact to improve the conductive characteristics thereof. A material having excellent conductivity, such as gold, silver and the like, may be used to perform the electroplating treatment.

In the contact according to the present disclosure, the inward-concave structures contact the pin to increase the effective conductive cross sectional area and reduce the resistance of the conductor, and thus a large current or signal may be transmitted. In addition, the distance between the tops of the inward-concave structures and the tops of the outward-convex structures is relatively short, that is, the conductive distance is reduced, thereby further reducing the resistance of the conductor, and thus the loss in the electric power and signal may be reduced.

Finally, it should be explained that the above embodiments are used only to explain the technical solution of the present disclosure, but not to limit the protection scope of the present disclosure. Although the present disclosure is described in detail with reference to preferred embodiments, it should be understand by those of ordinary skill in the art that modifications, equivalents or substitutions may be made to the technical solution of the present disclosure without departing from the spirit and scope of the technical solution of the present disclosure.

What is claimed is:

1. A contact, comprising a metal cylinder formed as a single body, the metal cylinder having a sidewall and a slit, wherein the sidewall is in a concave-convex undulating shape or circumferential extension, the sidewall of the metal cylinder comprising:

a plurality of inward-concave structures extending in a length direction of the metal cylinder and recessed toward a central axis of the metal cylinder; and a plurality of outward-convex structures extending in the length direction of the metal cylinder and protruding away from the central axis of the metal cylinder.

2. The contact of claim 1, wherein the inward-concave structures have inclined surfaces at ends thereof, and the inclined surfaces are inclined inward and toward the central axis of the metal cylinder.

3. The contact of claim 1, wherein the plurality of inward-concave structures and the plurality of outward-convex structures are arranged uniformly at a constant interval in a corrugated shape.

4. The contact of claim 1, wherein the outward-convex structures include grooves disposed on tangents at tops of the outward-convex structures.

5. The contact of claim 4, wherein the grooves extend alternately from both ends of the metal cylinder.

6. The contact of claim 1, wherein a sleeve is disposed outside the metal cylinder, and a snap ring is disposed at an opening of the sleeve to fasten the metal cylinder.

7. A method of manufacturing a contact, comprising:

stamping a metal sheet to form concave-convex structures;

chamfering ends of concave structures of the concave-convex structures;

performing notching on tangents at tops of the concave-convex structures to form grooves;

coiling the metal sheet to form a metal cylinder, wherein the concave structures are disposed inside the metal cylinder, and outward-convex structures of the concave-convex structures are disposed outside the metal cylinder; and inserting the metal cylinder into a sleeve having a snap ring at an opening of the sleeve, wherein the metal cylinder resiles and expands to be pressed against an inner wall of the sleeve.

8. The method of claim 7, wherein the grooves extend alternately from both ends of the metal cylinder, in tangent directions at the tops of the concave-convex structures, respectively.

9. The method of claim 7, wherein the grooves are disposed on tangents at tops of the outward-convex structures.

10. The method of claim 7, further comprising:

after coiling the metal sheet to form the metal cylinder, heat-treating the metal cylinder for 1 to 2.5 hours at a temperature in a range of 350 to 420° C.

* * * * *